United States Patent [19]

Meier et al.

[11] Patent Number: 5,007,681

[45] Date of Patent: Apr. 16, 1991

[54] FLUID-RESISTANT, UPHOLSTERED FURNITURE SEAT ADAPTED TO AID HOUSEKEEPING

[75] Inventors: Louis M. Meier, Dubuque, Iowa; Lloyd G. Berning, Hazel Green, Wis.

[73] Assignee: Flexsteel Industries, Inc., Dubuque, Iowa

[21] Appl. No.: 404,870

[22] Filed: Sep. 8, 1989

[51] Int. Cl.[5] ..... A47C 7/00

[52] U.S. Cl. ..... 297/440; 297/445

[58] Field of Search ..... 297/440, 443, 445

[56] References Cited

U.S. PATENT DOCUMENTS

| | | | |
|---|---|---|---|
| 2,965,161 | 12/1960 | Knoll | 297/440 |
| 3,030,146 | 4/1962 | Faxon | 297/440 |
| 3,171,690 | 3/1965 | Weiss | 297/440 |
| 3,380,777 | 4/1968 | Bennett | 297/440 |
| 3,896,531 | 7/1975 | Gorman | 297/440 X |
| 4,043,591 | 8/1977 | Lehmann | 297/440 X |
| 4,672,698 | 6/1987 | Sands | 297/440 X |
| 4,755,000 | 7/1988 | Chiaro et al. | 297/440 |
| 4,848,839 | 7/1989 | Galardo | 297/440 |

FOREIGN PATENT DOCUMENTS

| | | | |
|---|---|---|---|
| 7924 | of 1905 | United Kingdom | 297/440 |
| 1222070 | 2/1971 | United Kingdom | 297/440 |

*Primary Examiner*—Jose V. Chen

*Attorney, Agent, or Firm*—Emrich & Dithmar

[57] ABSTRACT

A fluid-resistant, upholstered furniture seat is adapted to aid housekeeping and includes a backrest portion, a removable seat portion and a seat portion support frame. The removable seat portion includes a monolithic fluid barrier, either in the form of an upholstery cover or a laminate, disposed over a seat cushion. Fluids spilled on the seat portion are not absorbed by the seat cushion and can easily be cleaned up. The seat portion support frame is formed to provide at least one large opening therein so that when the seat portion is removed, access is provided to the floor area under the furniture seat for easy cleaning.

14 Claims, 3 Drawing Sheets

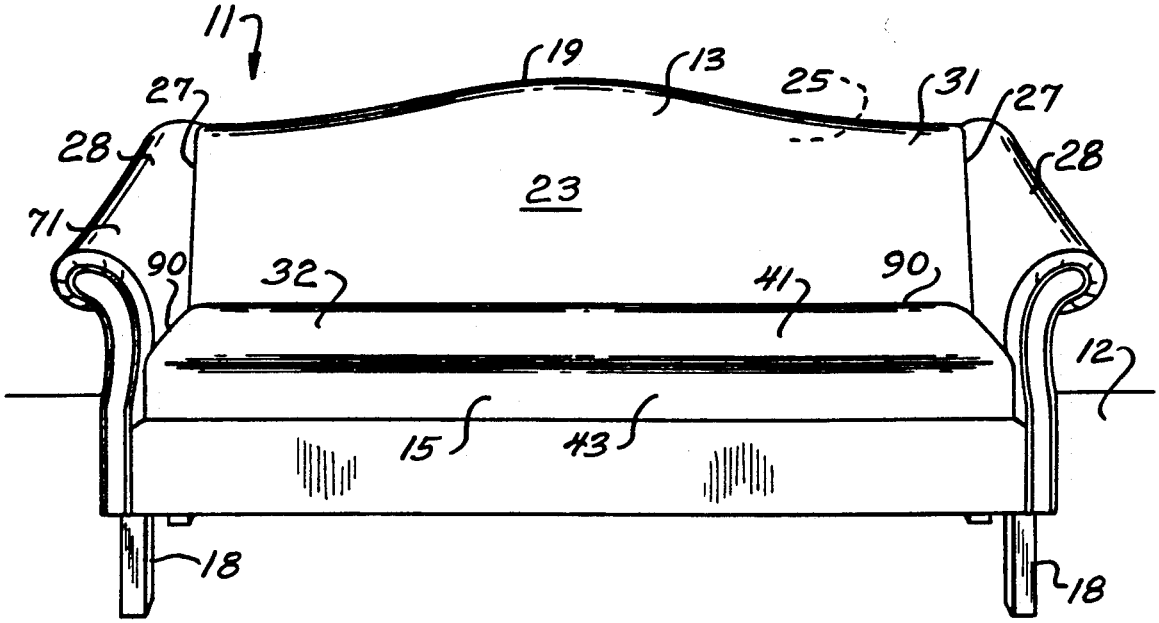
FIG. 1
FIG. 2
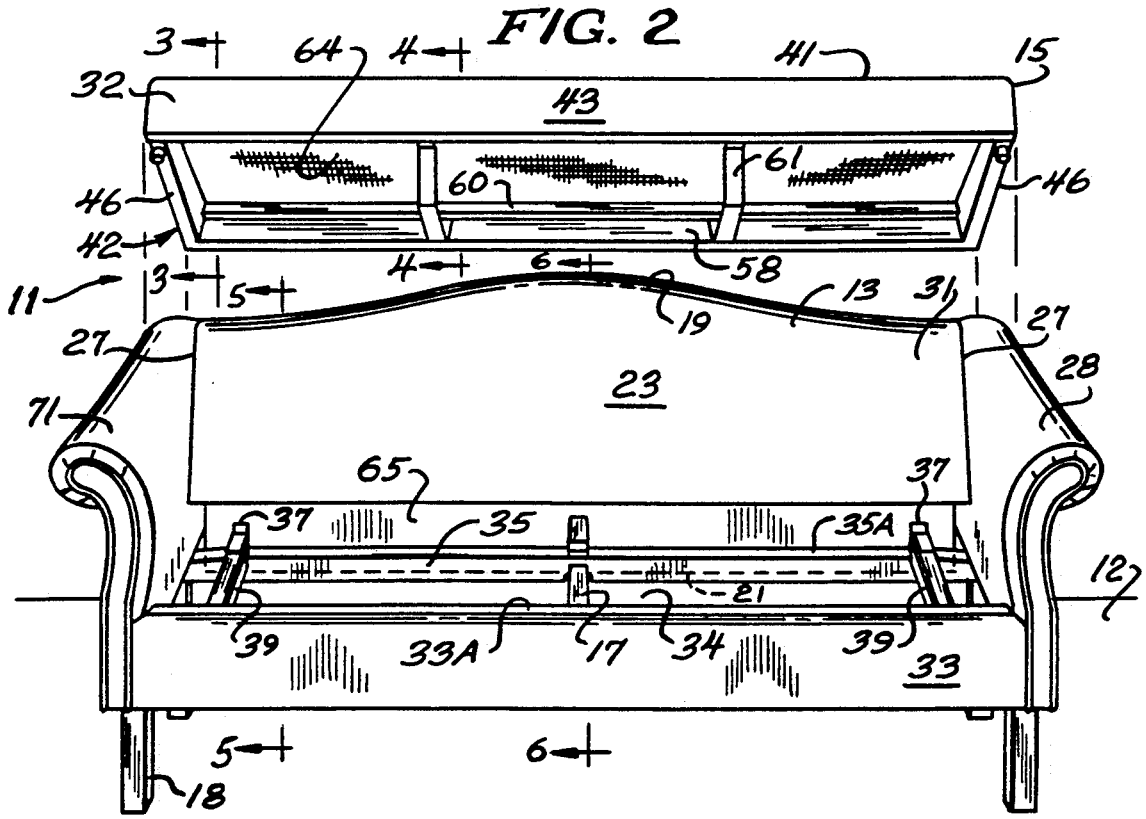

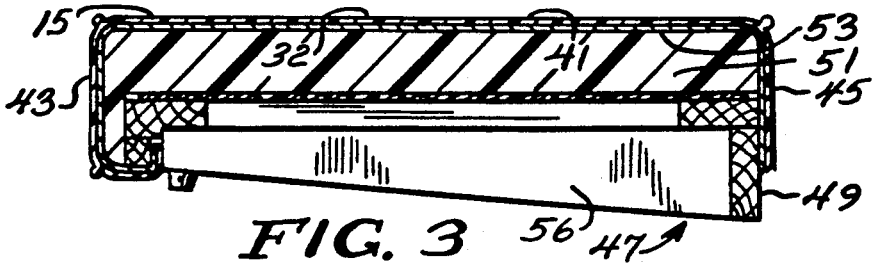
FIG. 3
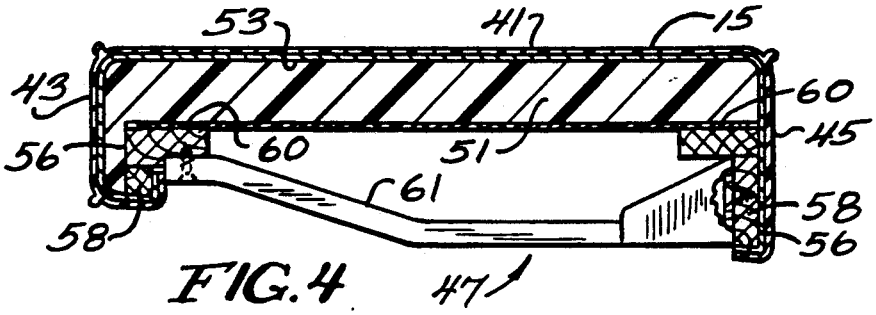
FIG. 4
FIG. 5
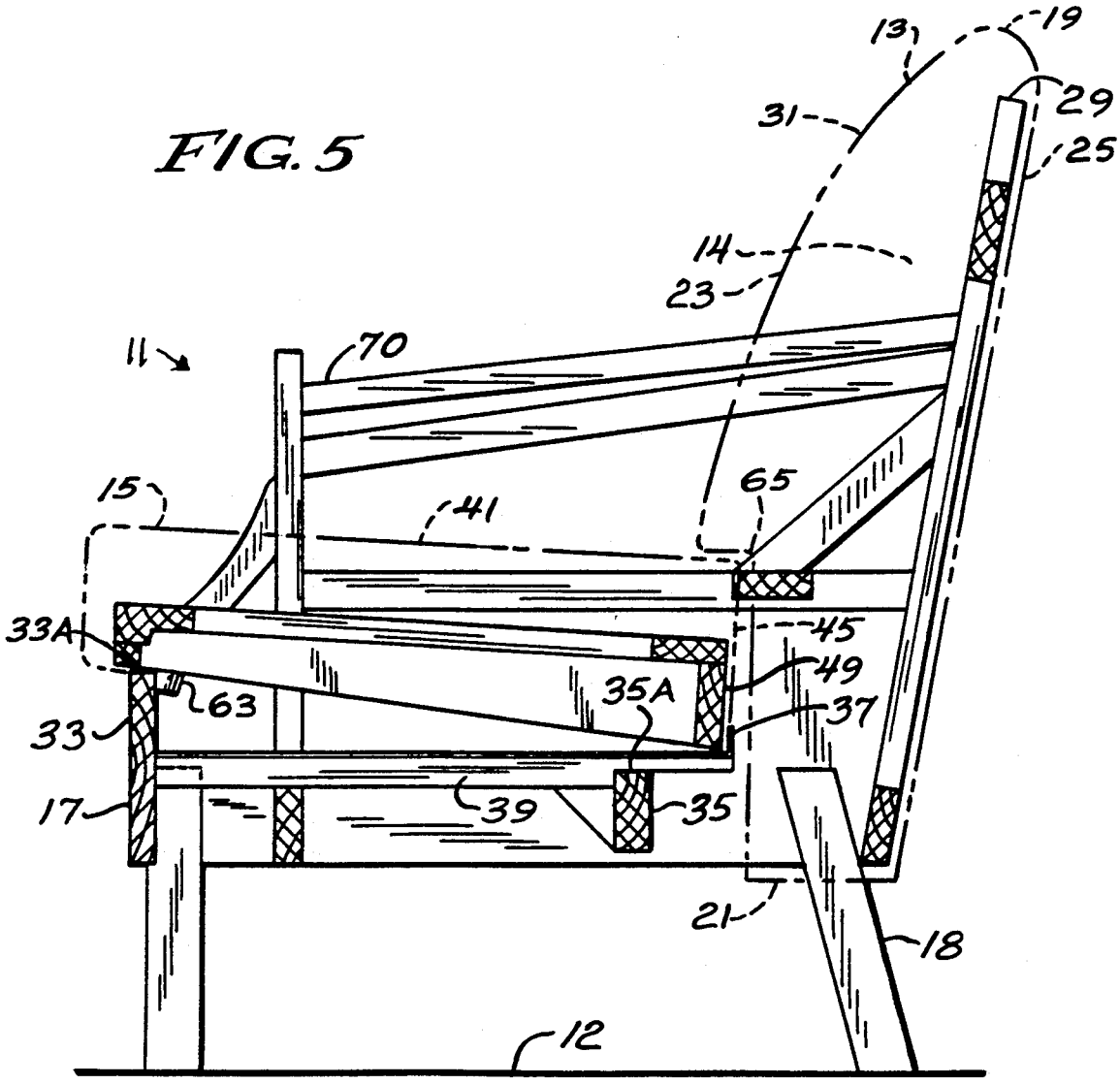

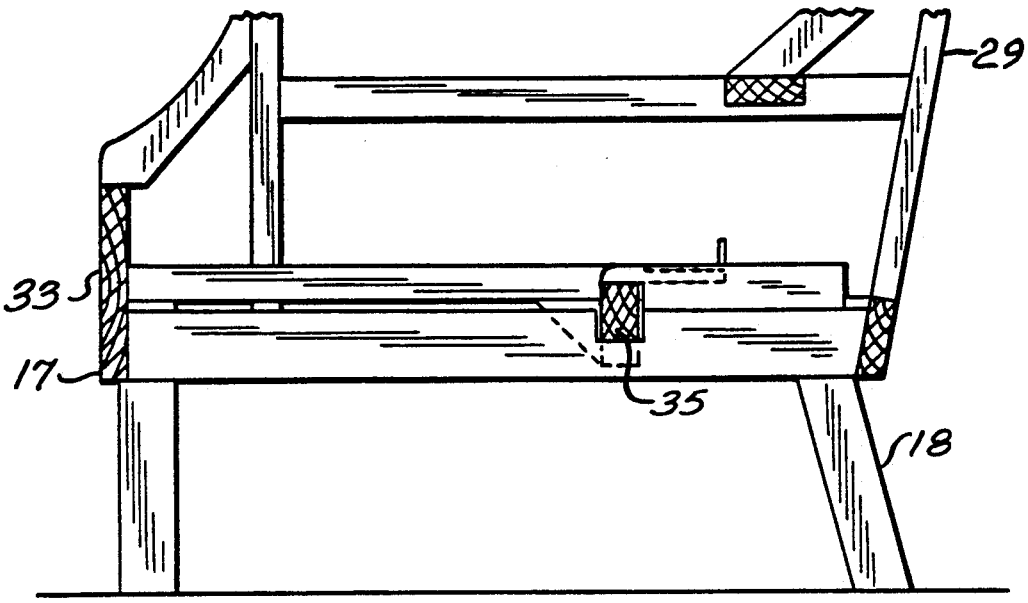
FIG. 6
FIG. 7
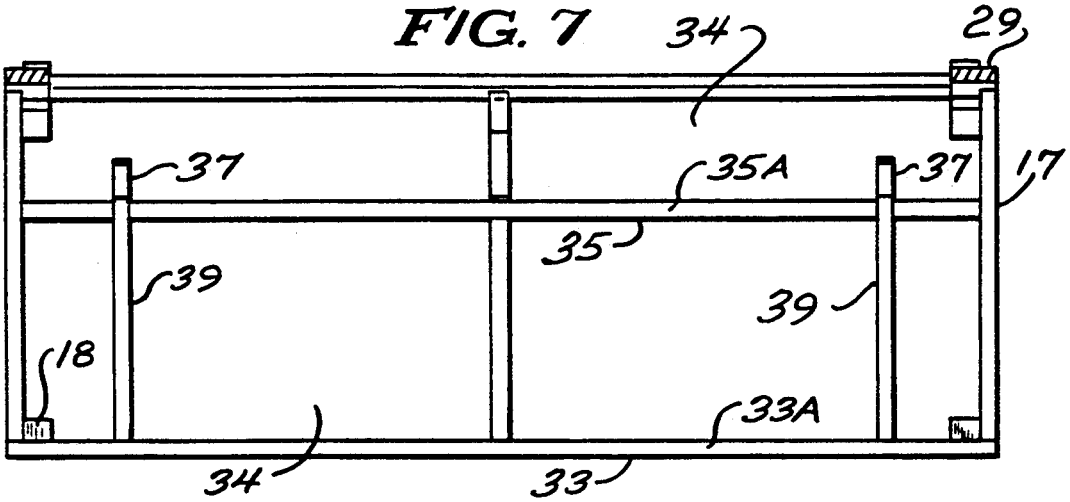
FIG. 8
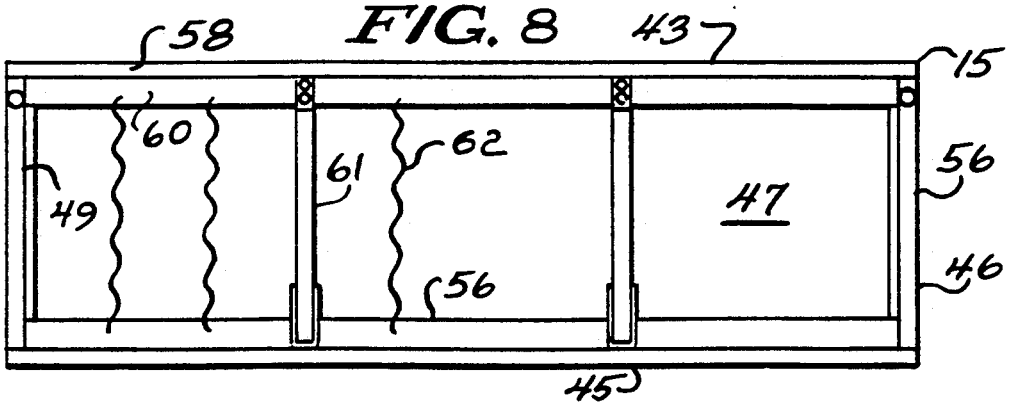

FLUID-RESISTANT, UPHOLSTERED FURNITURE SEAT ADAPTED TO AID HOUSEKEEPING

BACKGROUND OF THE INVENTION

1. Field of the Invention

The present invention relates generally to the field of seating furniture and more specifically to a furniture seat which is fluid-resistant and adapted to aid in the performance of housekeeping chores. The furniture seat of the invention is therefore particularly well-suited for use in a health care facility such as a hospital or geriatric home.

2. Description of the Prior Art

Health care institutions such as hospitals, and in particular long term health care institutions such as geriatric homes, have heretofore had great difficulty in maintaining upholstered seating furniture in a sanitary condition. Patients utilizing such furniture often suffer from a number of disorders such as incontinence or Parkinson's disease. Parkinson's disease makes it difficult for a patient to hold or drink beverages without spilling. Thus, the furniture seats in such institutions frequently become soiled.

As used herein, the terms "seating furniture" or "furniture seats" include both sofas and chairs. Traditional upholstered furniture seats generally include a seat portion and a backrest portion and may optionally include armrests. The seat portion, backrest portion and the armrests usually have a resilient cushion material, such as foam or soft batting, disposed between a frame member and an upholstery covering. The seat portion presents a substantially flat top surface which is generally horizontally disposed. The backrest portion includes an in-back side disposed substantially normal to the flat top surface of the seat portion. The optional armrests are located at opposite ends of the backrest portion and are substantially normal to both the top surface of the seat portion and the in-back side of the backrest portion. Thus, a crevice generally exists at the juncture between each of the aforesaid.

The upholstery covering on traditional furniture seats generally comprises a porous fabric material so that fluids which may be spilled thereon are absorbed by the upholstery cover and the underlying cushion or batting. Furthermore, spilled fluids tend to run into the crevices at the junctures between the seat portion, backrest portion and armrests. The fluids can also soil the floor area below the furniture seats.

In the past, health care institutions have often utilized upholstered seating furniture which includes a fluid-resistant upholstery covering such as vinyl or leather. While vinyl materials are impervious to most liquids, the vinyl upholstery coverings generally include sewn seams or zippers, which offer points of entry to the underlying cushion or batting materials. While such upholstery coverings offer some protection to the underlying cushions and batting, it is often difficult or impossible to remove spilled fluids from the crevices at the junctures between the seat portion and backrest portion and armrests.

Furniture seats having removable seat portions, supported by a support structure, are also known in the art. While such furniture seats make it possible to clean fluids from the crevices between the seat portion and backrest portion and seat portion and armrests, the support structure itself often becomes soiled. Many times the support structure is constructed of porous materials so that it absorbs the spilled fluids, which prevents cleaning the fluids therefrom. Finally, if a spilled fluid works its way to the floor area below the furniture seat, the entire furniture seat must be moved in order to clean up the spill.

BRIEF SUMMARY OF THE INVENTION

It is therefore and object of the invention to provide a fluid-resistant, upholstered furniture seat which is adapted to ease the performance of housekeeping chores.

It is another object of the invention to provide a fluid-resistant, upholstered furniture seat which includes a monolithic fluid barrier upholstery cover or a monolithic fluid barrier laminate over the seat portion cushion material so that fluids spilled on the seat portion are not absorbed by the cushion material.

It is another object of the invention to provide a fluid-resistant, upholstered furniture seat which has a fully removable seat portion so that fluids which are spilled on the furniture seat and which run into crevices at the juncture between the seat portion and backrest portion and seat portion and armrests can be readily cleaned up.

Still another object of the present invention is to provide a fluid-resistant, upholstered furniture seat which includes a removable seat portion and a seat portion support frame having large openings provided therein and wherein the removable seat portion is adapted for resting on the support frame, substantially covering the same so that fluids which are spilled on the seat portion will not tend to flow onto and soil the support frame. Furthermore, the large openings in the seat portions support frame permit the clean up of fluids from the floor area, without having to move the entire furniture seat.

The fluid-resistant, upholstered furniture seat of the invention is adapted for standing on a platform, such as a floor and comprises a backrest portion, a removable seat portion, a seat support frame and a plurality of feet. The backrest portion defines a substantially vertically oriented in-back side, an out-back side, a top edge and a bottom edge. The back rest portion further includes a backrest frame member and a fluid-resistant upholstery cover which covers the in-back side. The removable seat portion defines a substantially flat top surface and a bottom side and includes a seat portion frame member associated with the bottom side, a monolithic fluid barrier upholstery cover or a monolithic fluid barrier laminate associated with the flat top surface and a seat cushion disposed between the monolithic fluid barrier upholstery cover or laminate and the seat portion frame member. The seat portion support frame is provided with at least one large opening therein and is affixed to the backrest frame member. The seat portion support frame is adapted to carry the removable seat portion so that the substantially flat top surface is substantially horizontally oriented and extends outwardly from the back rest member, adjacent the in-back side and the bottom edge and so that the removable seat portion covers the support frame and opening formed therein. The invention consists of certain novel features and a combination of parts hereinafter fully described, illustrated in the accompanying drawings, and particularly pointed out in the appended claims, it being understood that various changes in the details may be made without departing from the spirit or sacrificing any of the advantages of the present invention.

BRIEF DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 1 is a perspective front elevation of the fluid-resistant, upholstered furniture seat of the present invention;

FIG. 2 is a perspective front elevation of the fluid-resistant, upholstered furniture seat shown in FIG. 1, with the removable seat portion removed from the seat portion support frame;

FIG. 3 is a vertical section of the removable seat portion shown in FIG. 2 and taken along line 3—3;

FIG. 4 is a vertical section of the removable seat portion shown in FIG. 2 and taken along line 4—4;

FIG. 5 is a vertical section of the frame members of the furniture seat of the invention shown in FIG. 2 and taken along line 5—5;

FIG. 6 is a fragmentary, sectional view of the lower portion of the seat portion support frame of the furniture seat of the invention shown in FIG. 2 and taken along line 6—6;

FIG. 7 is a top plan view of the seat support frame member of the furniture seat of the invention; and FIG. 8 is a bottom plan view of the removable seat portion frame of the fluid-resistant, upholstered furniture seat of the invention.

DETAILED DESCRIPTION OF THE INVENTION

Referring now to the drawings, and in particular to FIGS. 1, 2 and 5, there is illustrated a preferred embodiment of the fluid-resistant, upholstered furniture seat of the invention, generally indicated by reference numeral 11. The furniture seat 11 comprises: a backrest portion 13; a removable seat portion 15 and a seat portion support frame 17. The furniture seat 11 is adapted or standing on a platform such as a floor 12 and the backrest portion 13 and the seat support frame 17 are supported off the floor 12 by a plurality of legs 18. The backrest portion 13 defines an upper edge 19, a lower edge 21, an in-back side 23, an out-back side 25 and a pair of backrest ends 27. The furniture seat of the invention 11 may optionally include a pair of armrests 28 respectively disposed so as to be adjacent the backrest ends 27 at one end of said armrests 28.

The backrest member 13 includes a rigid backrest frame 29 (FIG. 5) and a fluid-resistant upholstery cover 31 which covers the in-back side 23 of the backrest portion 13 between the upper 19 and lower 21 edges and backrest ends 27. It will be clear to those skilled in the art that the furniture seat of the invention 11 will be more aesthetically pleasing if the upholstery cover 31 also covers the out-back side 25. The backrest 13 preferably includes a backrest cushion 14 disposed over the in-back side 23, between the upholstery cover 31 and frame 29. The backrest cushion 14 maybe fabricated from known material such as high resiliency polyurethane foam or bonded polyester fiber. It will be appreciated that the backrest frame 29 may also include resilient springs (not shown) which can add to the seating comfort to the user of the furniture seat 11.

Because the backrest portion 13 is substantially vertically oriented, any fluids spilled thereon will tend to quickly run off. The upholstery cover 31 is therefore described as fluid-resistant but need not necessarily function as a monolithic fluid barrier. Satisfactory materials for the fluid-resistant cover 31 include vinyl and vinylized fabrics but because it is not necessary to prevent a completely "liquid tight" barrier, the fluid-resistant upholstery cover may include sewn seams, exposed at the in-back side 23.

Nonetheless, it is preferable that the upholstery cover 31 be impenetrable to fluids in order to prevent absorption by the backrest cushion 14. Thus, the term monolithic fluid barrier upholstery cover is used to describe an upholstery covering fabricated from vinyl or vinylized fabric, or other such fabric impervious to most liquids, and wherein such fabrics are applied to the furniture seat 11 in such a manner that no openings, such as exposed sewn seams or zippers are present therein. Thus, it is preferable that the upholstery cover 31 provide a fluid barrier laminate over the in-back side 23 of the backrest portion 13.

FIGS. 2, 5, 6 and 7 illustrate the seat portion support frame 17, which includes a front rail 33 and a rear rail 35, each of which presents a substantially horizontal support surface 33A and 35A, respectively. Front rail 33 and rear rail 35 are spaced-apart and in a substantially parallel relationship. Rear rail 35 is further spaced-apart from and disposed adjacent the lower edge 21 and in-back side 23 of the backrest portion 19. The support surface 35A of rear rail 35 carries a pair of angle bearing stops 37 which may be mounted to optional ribs 39 employed to join front rail 33 and rear rail 35. Ribs 39 are referred to as optional because front 33 and rear 35 rails may be joined only to armrests 28 in order to secure the spaced-apart relationship between them. The use of ribs 39 is preferred, however, to lend strength and rigidity to the seat portion support frame 17.

It is important to note that seat portion support frame 17 is constructed so as to form at least one large opening 34 and preferably a plurality of such large openings 34 therein. Openings 34 provide access to the floor 12 (FIG. 2) upon removal of the removable seat portion 15. If fluids are spilled upon or in the vicinity of the furniture seat 11, and the fluids flow to the floor area 12 directly below the furniture seat, or if the spilled fluids soil the ribs 39 or rails 33, 35, the spilled fluids are easily cleaned up, without moving the entire furniture seat 11. Likewise, routine housekeeping chores such as dusting and mopping the floor 12 are made easier by the provision of the removable seat portion 15 and large openings 34.

It should be noted that rails 33 and 35 are preferably treated so as to be moisture-resistant. The rails 33 and 35 are most easily fabricated from wood and sealing the rails with a material such polyurethane prevents the rails from absorbing fluids which may be spilled thereon.

FIGS. 2, 3, 4 and 8 illustrate the configuration and construction of the removable seat portion 15. Seat portion 15 defines a substantially flat top surface 41, a front edge 43, a rear edge 45, a pair of side edges 46 and a bottom side generally indicated by reference numeral 47. The removable seat portion 15 is adapted for resting on the seat support frame 17, substantially covering the seat support frame 17 so that the flat top surface 41 extends continuously outward from the in-back side 23 of the backrest 13 to the front rail 33 of the seat support frame 17 (FIGS. 1 and 5). As best seen in FIGS. 3, 4 and 8, the removable seat portion 15 includes a rigid seat frame 49, a resilient seat cushion 51 and a monolithic fluid barrier upholstery cover 32. The seat cushion 51 may be fabricated from polyurethane foam or bonded fibers and is disposed between the seat frame 49 and the monolithic fluid barrier upholstery cover 32 in such a manner that the cover 32 and seat frame 49 are respectively associated with flat top surface 41 and bottom side 47. The seat frame 49 cooperates with support surface 33A on front rail 33 and a pair of angle bearing stops 37 carried by rear rail support surface 35A so that the substantially flat top surface 41 of the deck 17 inclines, in decreasing elevation, from front rail 33 toward the in-back side 23 of backrest portion 13 (FIG. 5). Fluids spilled on flat top surface 41 of the removable seat portion 15 will not be absorbed by the resilient cushion 51 but will tend to flow toward the in-back side 23 of the backrest portion 13, over the rear edge 45 and onto the floor 12, without contacting rear rail 35.

It will be appreciated that angle bearing stops 37 are illustrated as being affixed to ribs 39 which are in turn carried on support surface 35A. It will be appreciated that bearing stops 37 may be affixed directly to support surface 35A.

The monolithic fluid barrier upholstery cover 32 provides a "liquid-tight" seal over the seat cushion 51. In a hospital or geriatric home, the monolithic fluid barrier upholstery cover 32 is preferably fabricated from a material which is (or is treated chemically so as to be) antibacterial, flame retardant, antistatic and non-toxic. Again, vinyl and vinylized fabrics have bee found to be ideal materials for this application.

The removable seat portion 15 is illustrated to include an optional monolithic fluid barrier laminate 53, disposed between the upholstery cover 32 and seat cushion 51. In such instance, the upholstery cover 32 need not be fabricated from a monolithic material which is impervious to liquids. The upholstery cover 32 may then be constructed so as to bee only fluid-resistant, as the passage of fluids to the seat cushion will be prevent by the monolithic fluid barrier laminate 53. A material known and sold under the trademark Chem-Safe Jr. is well-suited for this purpose.

As can be readily seen from FIG. 3, the fluid barrier laminate 53 and upholstery cover 32 are made monolithic by affixing a single, continuous sheet of these materials to the seat portion frame 49 so that the front 43, rear 45 and side 46 edges are covered and the seat cushion 15 is "sealed" from liquids spilled on top surface 41.

FIGS. 4 and 8 show that the removable seat portion frame 49 may include wooden frame members 56 arranged in a generally rectangular configuration so as to define the overall shape of the removable seat portion 15. Wooden support members 56 are preferably arranged so as to provide a substantially vertical brace 58 and a substantially horizontal platform 60 (FIG. 4). Horizontal platforms 60 also provide support to seat cushion 51 and may be used to anchor sinusoidal springs 62. In place of sinusoidal springs, a sheet material 64, sold under the registered trademark Dymetrol, may be affixed to the frame 49 (FIG. 2). This material was originally developed for use in automobile seats and will provide additional support for the seat cushion 51 but will not rust or corrode.

When the furniture seat 11 is used, vertical braces 58 distribute the load applied through the seat portion 15 to the horizontal support surface 33A of front rail 33 and angle bearing stops 37. The use of wooden support members 58 permits upholstery cover 32 and monolithic fluid barrier laminate 53 to be affixed thereto by the use of staples or tacks. This is preferably done at the bottom side 47 of the seat portion 15 so that no openings are found in the upholstery cover 32 or fluid barrier laminate 53 to permit the entry of fluids to the underlying cushion 51.

Vertical braces 58 also define the front 43, rear 45 and side 46 edges of the removable seat portion 15. The seat portion frame 49 may optionally include a plurality of seat ribs 61 which may be fabricated from steel, wood or other material to lend rigidity and strength to the seat portion frame 49. Seat ribs 61 are spaced so as to avoid contact with horizontal ribs 39 in the seat support frame 17 when the removable seat portion 15 is rested thereon. FIG. 2 discloses such a spaced relationship between the seat ribs 61 in frame 49 and horizontal ribs 39 in the seat portion support frame 17.

In order that the removable seat portion 15 be securely positioned upon the seat support frame 17, a second pair of bearing stops 63 may be optionally associated with removable seat portion 15. FIG. 5 discloses the positioning of optional bearing stops 63 wherein they are illustrated to cooperate with front rail 33 of seat portion support frame 17. Thus, angle bearing stops 37 and secondary optional stops 63 prevent the seat portion 15 from sliding off the seat portion support frame 17 unless the seat portion 15 is first raised to clear the secondary stops 63.

FIGS. 2 and 5 show that the in-back side 23 of the backrest portion 13 has a slight recess 65 formed adjacent the bottom edge 21. Recess 65 is preferably provided to receive the rear edge 45 of the removable seat portion 15 when the removable seat portion 15 is rested upon seat portion support frame 17. This recess 65 provides a tight fit between the removable seat portion 15 and backrest member 13 so that fluid spills on substantially flat top surface 41 will be hindered from flowing over rear edge 45. Thus, most fluid spills can be cleaned up before reaching the floor area 12.

It will be appreciated that optional armrests 28 are substantially vertically oriented but substantially normal to both backrest portion 13 and seat portion 15. Like the aforesaid members, armrests 28 include a frame member 70 (FIG. 5) which is covered with a fluid-resistant upholstery covering 71 (FIGS. 1, 2), and which preferably matches upholstery coverings 31 and 32. Similarly, an armrest cushion material (not shown) may be disposed between frame member 70 and upholstery cover 71 for comfortable use.

FIG. 5 further discloses the preferred construction of the furniture seat 11. Backrest frame member 29, seat portion support frame 17 and optional armrest frame members 70 are all joined so that the frame members, excluding the frame member of the removable seat portion, are fabricated as a monolithic unit. Such construction lends rigidity and strength to the furniture seat of the invention 11.

Finally, FIG. 1 discloses that the backrest member 13, seat portion 15 and armrests 28 form crevices 90 at their junctures, as in prior art furniture seats. As illustrated in FIG. 2, the furniture seat of the invention 11 permits easy cleaning of the surfaces associated with the crevices 90 by removal of seat portion 15. Furthermore, removal of the removable seat portion 15, and the construction of the seat support frame 17 which provides large openings 34, permit easy cleaning of the support frame itself 17 and the floor area 12 located below the furniture seat 11. The fluid-resistant features of the upholstery coverings 31 and 71, the monolithic fluid barrier upholstery cover 32, or optionally the fluid-resistant upholstery cover 32 in combination with the fluid barrier laminate 53 used in the construction of the removable seat portion, and the aforementioned provisions for accessibility to crevice surfaces and the underlying floor, make the furniture seat of the invention 11 ideal for use in institutions where high levels of cleanliness are required.

It will be appreciated that while the foregoing description of the fluid-resistant, upholstered furniture seat of the invention includes specific details as to elements such as ribs and armrests etc. that such details are for the purpose of illustrating the invention and not intended as a limitation of the scope of the invention.

What is claimed is:

1. A fluid resistant, upholstered furniture seat for use in health care and adapted for standing on a platform such as a floor, comprising:

a backrest portion defining an in-back side, an out-back side, a top edge and a bottom edge, said in-back side being substantially vertically oriented;

said backrest portion including a backrest frame member and a fluid-resistant upholstery cover covering said in-backside;

a removable seat portion defining a substantially flat top surface and a bottom side;

said removable seat portion including a seat portion frame member associated with said bottom side, a monolithic fluid barrier upholstery cover covering said substantially flat top surface, a seat cushion disposed between said monolithic fluid barrier upholstery cover and said seat portion frame member;

a seat portion support frame member affixed to said backrest frame member for providing support for, without being coupled to, said removable seat portion so that said substantially flat top surface is substantially horizontally oriented and extends outwardly from said backrest member, adjacent said in-back side and said bottom edge;

structural means including bearing stop means disposed on either the lower portion of said seat portion frame member or on the upper portion of said seat portion support frame member for preventing forward or aft displacement of said seat portion frame member on said support frame while allowing said seat portion frame member to be lifted vertically in removing said seat portion frame member from said support frame member;

said removable seat portion covering said support frame and said opening formed in said support frame, with said substantially flat top surface of said removable seat portion inclining in decreasing elevation towards said backrest member when said removable seat portion is carried on said seat portion support frame; and a plurality of feet adapted for supporting said backrest member and said seat support frame above said platform.

2. The furniture seat of claim 1 and further comprising:

said backrest portion defining a pair of backrest ends;

an armrest located adjacent each of said backrest ends;

each of said armrests including a frame member covered with a fluid-resistant upholstery covering; and said armrest frame members being affixed to said backrest frame members.

3. The furniture seat of claim 1 wherein:

said seat portion support frame includes a front rail and rear rail, said rails spaced-apart and in a substantially parallel relationship;

said rear rail being spaced-apart from and adjacent to said bottom edge of said in-back side of said backrest member; and said front and rear rails have a substantially horizontal support surface formed thereon;

wherein said stop bearing means of said structural means includes a pair of angle bearing stops carried by said rear rail.

4. The furniture seat of claim 3 wherein said stop bearing means of said structural means further comprises at least one secondary bearing stop affixed to said removable seat portion frame member and adapted for cooperation with said front rail so that said removable seat portion must be vertically lifted to remove the same from said seat portion support frame.

5. The furniture seat of claim 3 further comprising a plurality of ribs affixed to said front and rear rails.

6. The furniture seat of claim 1 wherein said fluid resistant upholstery covers and said monolithic fluid barrier upholstery covers are fabricated from vinyl or vinylized fabrics.

7. The furniture seat of claim 1 further comprising a monolithic fluid barrier laminate disposed between said top surface and said seat cushion of said removable seat portion.

8. The furniture seat of claim 1 further comprising a backrest cushion disposed between said upholstery cover and said frame member of said in-back side of said backrest portion.

9. The furniture seat of claim 1 wherein said seat cushion is fabricated from polyurethane.

10. A fluid resistant, upholstered furniture seat adapted for standing on a platform such as a floor, comprising:

a backrest member which defines an upper edge, a lower edge, an in-back side, an out-back side and a pair of backrest ends;

said backrest member including a rigid backrest frame and a monolithic fluid barrier upholstery cover, which upholstery cover covers the in-back side of the backrest member between the upper and lower edges and backrest ends;

a rigid seat support frame affixed to the backrest frame;

said seat support frame including a front rail and a rear rail, each of which rails presents a substantially horizontal support surface;

said front rail and said rear rail being spaced apart in substantially parallel relation with said front rail being at a higher elevation than said rear rail so as to define at least one large opening therebetween and said rear rail being spaced apart from and disposed adjacent the lower edge and in-back side of said backrest member;

a removable seat portion which defines a substantially flat top surface, a front edge, a rear edge, a pair of side edges and a bottom side, said removable seat portion being adapted for resting on said seat support frame and substantially covering the same so that the rear edge of said removable seat portion lies adjacent the in-back side of said backrest and said flat top surface extends continuously outward from the in-back side of said backrest, over the front rail of said seat support frame;

said removable seat portion including a rigid seat portion frame, a resilient cushion and a monolithic fluid barrier laminate, said cushion being disposed between the seat support frame and said laminate and said seat portion frame being respectively associated with said flat top surface and said bottom side;

structural means cooperating with said seat portion frame and said seat support frame for preventing forward or aft movement of said seat portion frame on said seat support frame while permitting said seat portion frame to be vertically lifted and removed from said seat support frame, said structural means including forward and aft bearing stops disposed on said seat portion frame and said seat support frame;

said seat portion frame cooperating with the support surface on said higher elevated front rail and said bearing stops associated with said rear rail, causing said substantially flat top surface of said seat portion to incline, in decreasing elevation, from said front rail toward the in-back side of the backrest member; and a plurality of feet affixed to said backrest frame member and said seat portion support frame.

11. The furniture seat of claim 10 further comprising said rails being treated so as to be moisture resistant.

12. The furniture seat of claim 11 wherein said rails are treated with polyurethane.

13. A fluid resistant, upholstered furniture seat adapted for standing on a platform such as a floor, comprising:

a backrest portion defining an in-back side, an out-back side, a top edge and a bottom edge, said in-back side being substantially vertically oriented;

said backrest portion including a backrest frame member and fluid-resistant upholstery cover covering said in-back side;

a removable seat portion defining a substantially flat top surface and a bottom side;

said removable seat portion including a seat portion frame member associated with said bottom side, a monolithic fluid barrier upholstery cover covering said flat top surface, a seat cushion disposed between said monolithic fluid barrier upholstery cover and said seat portion frame member;

a seat portion support frame member affixed to said backrest frame member for providing support for, without being coupled to, said removable seat portion so that said substantially flat top surface is substantially horizontally oriented and extends outwardly from said backrest member, adjacent said in-back side and said bottom edge, said seat portion support frame including a front rail and rear rail, with said rails spaced-apart and in substantially parallel relationship, with said rear rail being spaced-apart from and adjacent to said bottom edge of said in-back side of said backrest member and said front and rear rails have a substantially horizontal support surface formed thereon;

structural means disposed on a lower portion of said seat portion frame member and an upper portion of said seat portion support frame member for preventing forward or aft displacement of said seat portion frame member on said support frame member while allowing said seat portion frame member to be lifted vertically in removing said seat portion frame member from said support frame member, wherein said structural means includes a pair of angle bearing stops carried by said rear rail and at least one secondary bearing stop affixed to said removable seat portion frame member and adapted for cooperation with said front rail so that said removable seat portion must be vertically lifted to remove the same from said seat portion support frame;

said seat portion support frame being formed so as to provide at least one large opening therein;

said removable seat portion covering said support frame and said opening formed in said support frame when said removable seat portion is carried on said seat portion support frame; and a plurality of feet adapted for supporting said backrest member and said seat support frame above said platform.

14. A fluid resistant, upholstered furniture seat adapted for standing on a platform such as a floor, comprising:

a backrest portion defining an in-back side, an out-back side, a top edge and a bottom edge, said in-back side being substantially vertically oriented;

said backrest portion including a backrest frame member and a fluid-resistant upholstery cover covering said in-back said;

a removable seat portion defining a substantially flat top surface and a bottom side;

said removable seat portion including a seat portion frame member associated with said bottom side, a monolithic fluid barrier upholstery cover covering said flat top surface, a seat cushion disposed between said monolithic fluid barrier upholstery cover and said seat portion frame member;

a seat portion support frame member affixed to said backrest frame member for providing support for, without being coupled to, said removable seat portion so that said substantially flat top surface is substantially horizontally oriented and extends outwardly from said backrest member, adjacent said in-back side and said bottom edge, said seat portion support frame including a front rail and rear rail, with said rails spaced-apart and in substantially parallel relationship, and comprising a plurality of ribs affixed to said front and rear rails with said rear rail being spaced-apart from and adjacent to said bottom edge of said in-back side of said backrest member and said front and rear rails have a substantially horizontal support surface formed thereon;

structural means disposed on a lower portion of said seat portion frame member and an upper portion of said seat portion support frame member for preventing forward or aft displacement of said seat portion frame member on said support frame member while allowing said seat portion frame member to be lifted vertically in removing said seat portion frame member from said support frame member, wherein said structural means includes a pair of angle bearing stops carried by said rear rail and at least one secondary bearing stop affixed to said removable seat portion frame member and adapted for cooperation with said front rail so that said removable seat portion must be vertically lifted to remove the same from said seat portion support frame;

said seat portion support frame being formed so as to provide at least one large opening therein;

said removable seat portion covering said support frame and said opening formed in said support frame when said removable seat portion is carried on said seat portion support frame; and a plurality of feet adapted for supporting said backrest member and said seat support frame above said platform.

* * * * *

UNITED STATES PATENT AND TRADEMARK OFFICE

CERTIFICATE OF CORRECTION

PATENT NO. : 5,007,681

DATED : April 16, 1991

INVENTOR(S) : Louis M. Meier, Lloyd G. Berning

It is certified that error appears in the above-identified patent and that said Letters Patent is hereby corrected as shown below:

Column 3, line 45, "or" should read --for--.

Column 5, line 42, "bee" should read --be--.

Column 5, line 43, "prevent" should read --prevented--.

Column 7, line 52, "frame while" should read --frame member while--.

Signed and Sealed this

First Day of September, 1992

*Attest:*

DOUGLAS B. COMER

*Attesting Officer*

*Acting Commissioner of Patents and Trademarks*